US009095198B2

(12) United States Patent
Apodaca et al.

(10) Patent No.: US 9,095,198 B2
(45) Date of Patent: Aug. 4, 2015

(54) LOOSE POWDER COMPACT WITH COMPRESSIBLE PLATFORM

(71) Applicant: HCT Group Holdings Limited, Santa Monica, CA (US)

(72) Inventors: Adrian C. Apodaca, Santa Monica, CA (US); Nick Gardner, Santa Monica, CA (US)

(73) Assignee: HCT GROUP HOLDINGS LIMITED, Santa Monica, CA (US)

( * ) Notice: Subject to any disclaimer, the term of this patent is extended or adjusted under 35 U.S.C. 154(b) by 0 days.

(21) Appl. No.: 13/951,348

(22) Filed: Jul. 25, 2013

(65) Prior Publication Data

US 2015/0027487 A1 Jan. 29, 2015

(51) Int. Cl.

| | |
|---|---|
| ***A45D 33/02*** | (2006.01) |
| ***A45D 33/22*** | (2006.01) |
| ***A45D 33/00*** | (2006.01) |
| ***B65D 69/00*** | (2006.01) |
| ***B65D 71/00*** | (2006.01) |

(52) U.S. Cl.

CPC ..... *A45D 33/006* (2013.01); *A45D 33/003* (2013.01); *A45D 33/02* (2013.01); *A45D 33/025* (2013.01)

(58) Field of Classification Search

CPC ..... A45D 33/00; A45D 33/02; A45D 33/06; A45D 33/003; A45D 33/005; A45D 33/025; A45D 33/006; A45D 2200/05; A45D 11/008; A45D 13/02; A45D 83/00; A45D 83/0811; A45D 83/04; A45C 5/005

USPC ..... 132/307, 286, 293, 294, 295, 296, 132/298–301, 303, 291, 305, 306, 313, 132/314–317; 206/581, 823, 235; 222/189.02, 189.03, 189.06, 189.05, 222/480, 142.9, 548, 565; 220/370, 371, 220/372, 531, 803–806; 209/371, 397; 215/231

See application file for complete search history.

(56) References Cited

U.S. PATENT DOCUMENTS

| | | | | | |
|---|---|---|---|---|---|
| 1,616,381 | A | * | 2/1927 | MacDougall | 132/298 |
| 2,055,389 | A | * | 9/1936 | Rosenberg | 132/306 |
| 3,552,402 | A | * | 1/1971 | Levy | 132/293 |
| 4,681,127 | A | * | 7/1987 | Gueret | 132/301 |

(Continued)

FOREIGN PATENT DOCUMENTS

| | | | |
|---|---|---|---|
| JP | 2002306236 | A | 10/2002 |
| KR | 200322309 | Y1 | 8/2003 |

(Continued)

OTHER PUBLICATIONS

The PCT Search Report and Written Opinion mailed Oct. 21, 2014 for PCT application No. PCT/US14/44907, 9 pages.

*Primary Examiner* — Vanitha Elgart

(74) *Attorney, Agent, or Firm* — Seager, Tufte & Wickhem LLC

(57) ABSTRACT

Disclosed is a compact for containing a loose powder, such as cosmetic finishing powder, including a base, a cover, a sifter, and a platform compressible against the sifter. The platform may comprise an inner portion flexibly coupled to an outer portion via a gasket disposed on at least a portion of a bottom surface of the inner portion. The compact may have an open position and a closed position. In the closed position, the cover may apply a downward force on the inner portion, compressing the gasket against the sifter and creating a seal to isolate the loose powder.

23 Claims, 5 Drawing Sheets

(56) References Cited

U.S. PATENT DOCUMENTS

| | | | | | |
|---|---|---|---|---|---|
| 4,696,317 | A | * | 9/1987 | Shioi et al. | 132/314 |
| 5,107,871 | A | * | 4/1992 | Butcher et al. | 132/304 |
| 5,431,176 | A | | 7/1995 | Favre | |
| 5,598,929 | A | * | 2/1997 | Jensen et al. | 206/527 |
| 5,603,340 | A | | 2/1997 | Gueret | |
| 5,704,378 | A | * | 1/1998 | Machelett | 132/304 |
| 5,769,234 | A | * | 6/1998 | Gueret | 206/581 |
| 5,839,626 | A | | 11/1998 | Gross et al. | |
| 5,875,795 | A | | 3/1999 | Bouix | |
| 5,896,866 | A | | 4/1999 | Quennessen | |
| 5,976,616 | A | | 11/1999 | Celia | |
| 5,988,185 | A | * | 11/1999 | Gueret | 132/294 |
| 6,053,183 | A | * | 4/2000 | Rizzo | 132/307 |
| 6,119,891 | A | | 9/2000 | Favre | |
| 6,138,686 | A | | 10/2000 | Yuhara | |
| 6,138,687 | A | * | 10/2000 | Sheffler et al. | 132/295 |
| 6,149,008 | A | * | 11/2000 | Yuhara | 206/581 |
| 6,202,902 | B1 | | 3/2001 | Starr | |
| 6,311,701 | B1 | * | 11/2001 | Yuhara et al. | 132/294 |
| 6,336,460 | B2 | * | 1/2002 | Yuhara | 132/295 |
| 6,354,308 | B1 | | 3/2002 | Kuk | |
| 6,706,775 | B2 | | 3/2004 | Hermann et al. | |
| 6,945,403 | B2 | * | 9/2005 | Lombardi | 206/581 |
| 7,028,843 | B2 | * | 4/2006 | Byun | 206/581 |
| 7,316,235 | B2 | * | 1/2008 | Maio et al. | 132/293 |
| 7,334,685 | B2 | | 2/2008 | Mathiez | |
| 7,337,787 | B2 | | 3/2008 | Matsuoka | |
| 7,494,030 | B2 | | 2/2009 | Bennett | |
| 7,832,564 | B2 | | 11/2010 | Kim | |
| 8,006,707 | B2 | * | 8/2011 | Thorpe et al. | 132/307 |
| 8,025,067 | B2 | * | 9/2011 | Thorpe et al. | 132/307 |
| 8,118,040 | B2 | | 2/2012 | Bennett | |
| 8,132,578 | B2 | * | 3/2012 | LoPrete | 132/307 |
| 8,210,187 | B1 | * | 7/2012 | Zhang | 132/299 |
| 8,286,648 | B2 | * | 10/2012 | Thorpe et al. | 132/307 |
| 8,387,627 | B2 | * | 3/2013 | Yeom | 132/307 |
| 8,678,222 | B2 | * | 3/2014 | Thorpe et al. | 220/291 |
| 2002/0056660 | A1 | * | 5/2002 | Gueret | 206/525 |
| 2003/0154997 | A1 | * | 8/2003 | Lin | 132/307 |
| 2005/0011895 | A1 | * | 1/2005 | Lin | 220/300 |
| 2006/0186019 | A1 | * | 8/2006 | Lu | 206/581 |
| 2007/0187284 | A1 | * | 8/2007 | Goto et al. | 206/581 |
| 2008/0011320 | A1 | * | 1/2008 | Bouix et al. | 132/293 |
| 2008/0264440 | A1 | * | 10/2008 | Thorpe | 132/299 |
| 2009/0188518 | A1 | * | 7/2009 | Thorpe et al. | 132/307 |
| 2009/0205673 | A1 | * | 8/2009 | Richardson | 132/307 |
| 2009/0320874 | A1 | | 12/2009 | Boye et al. | |
| 2011/0253166 | A1 | * | 10/2011 | Lin | 132/307 |
| 2013/0068801 | A1 | * | 3/2013 | Lai | 222/565 |
| 2013/0087165 | A1 | * | 4/2013 | Lee et al. | 132/286 |
| 2014/0023689 | A1 | | 1/2014 | Kim et al. | |
| 2014/0154295 | A1 | | 6/2014 | Sim et al. | |

FOREIGN PATENT DOCUMENTS

| | | | |
|---|---|---|---|
| KR | 20090004125 | A | 1/2009 |
| KR | 20090104593 | A | 10/2009 |

* cited by examiner

LOOSE POWDER COMPACT WITH COMPRESSIBLE PLATFORM

BACKGROUND

Cosmetic materials such as those used for cosmetic foundation or finishing are typically provided as a compacted or a loose material. Loose materials, including loose powder, are becoming more common in part because loose material provides improved coverage of the material on a surface. The loose material may be provided in a container with a base, cover, and perforated divider or sifter so that the container may be opened and the powder may be shaken out of the perforations and applied to an applicator.

A typical loose powder container will have a means for opening and closing the cover, such as a threaded screw-type mechanism. Some containers may also include a sealing platform, internal lid, or rotating sifter held in place over the perforated divider. These features prevent loose material from moving up through the perforations during handling and/or jostling of the container, such as the movements associated with carrying the container in a handbag, pocket, or purse.

Although some users apply cosmetic products in their homes without concern for time, many apply cosmetic products hurriedly, for instance while driving a car, using a public restroom, working in an office, walking, or taking a break. In these uses, interfacing with additional features and locking mechanisms can become burdensome for the user, especially when the vessel contains a fine powder. The multiple internal components and locking mechanism in some loose powder compacts may make it difficult for a user to cleanly and easily access the contained material in a hurried manner. Accordingly, there remains a need for improved cosmetic containers.

BRIEF DESCRIPTION OF THE DRAWINGS

The detailed description is set forth with reference to the accompanying figures. In the figures, the left-most digit(s) of a reference number identifies the figure in which the reference number first appears. The use of the same reference numbers in different figures indicates similar or identical items.

DETAILED DESCRIPTION

Overview

Figure 1:
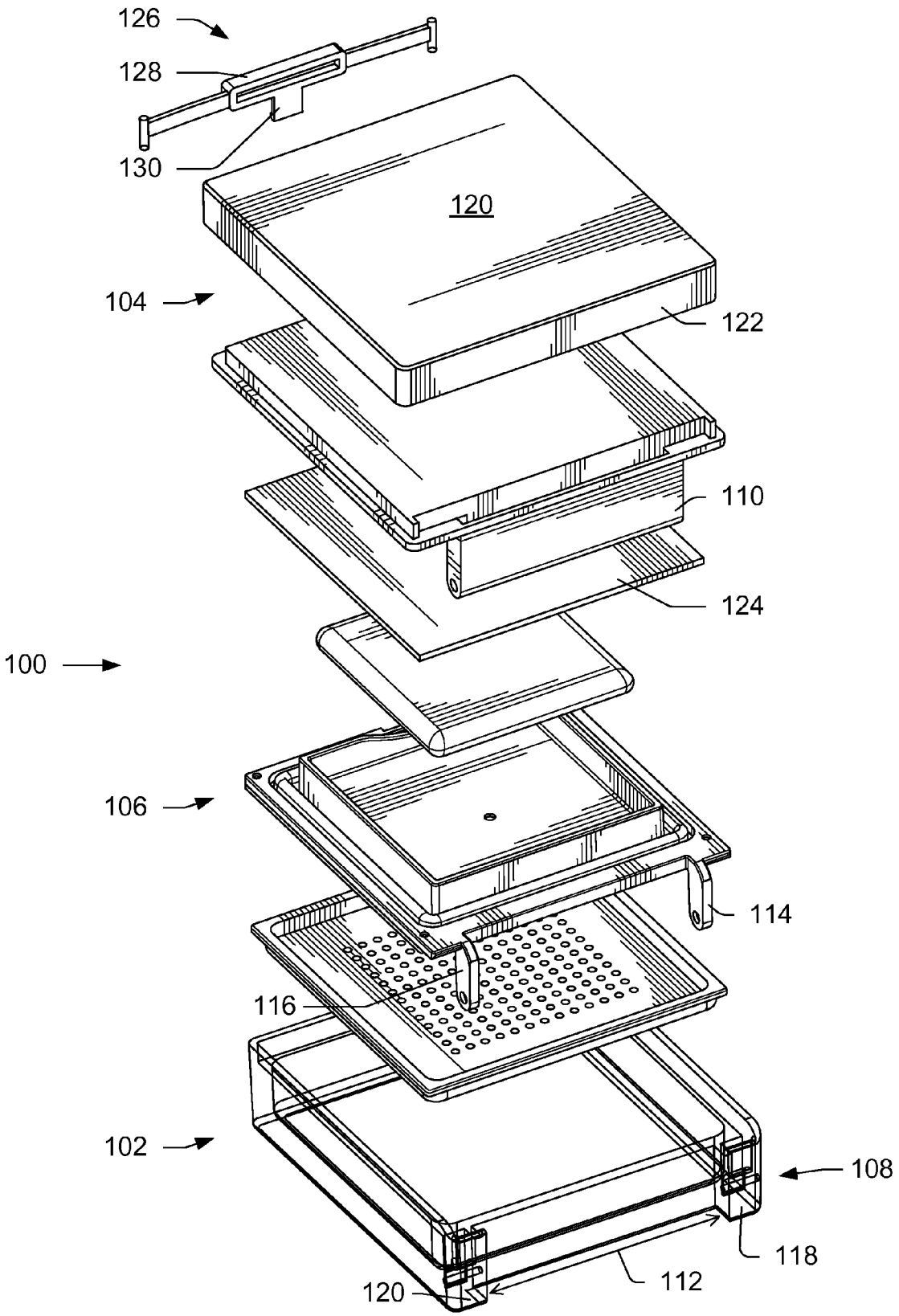
FIG. 1 is a rear perspective exploded view of an example loose powder compact.

One implementation of this disclosure is directed towards a compact with a compressible platform and a vessel for containing cosmetic product. The vessel of the compact may be configured to contain a loose powder, such as finishing powder, and provide access to the powder with the actuation of a single closing mechanism to minimize user interactions.

For instance, the compact may include a cover pivotably coupled to a base, a sifter disposed within the base, and a compressible platform disposed above the sifter. The compressible platform may include an inner portion flexibly coupled to an outer portion via a gasket that couples to a bottom surface of the inner portion and a bottom surface of the outer portion. In some examples, the gasket may be comprised of silicone, thermoplastic elastomer (TPE), and/or any other compressible material. When the cover is moved into a closed position, it may make contact with and vertically displace the inner portion of the compressible platform, compressing the gasket on the bottom surface of the inner portion against the sifter to create a seal.

In other implementations, a living hinge may be included for flexibly coupling the inner portion to the outer portion. Additionally or alternatively, a liner may be positioned on the bottom surface of the inner portion. In this implementation, when the cover is moved to the closed position, it displaces the inner portion, bending the living hinges, and compressing the liner against the sifter.

In some implementations, a push button locking mechanism may be situated on an outer surface of the compact to release the cover from the closed position when actuated. The coupling portion of the gasket, being deformed when the inner portion is depressed, may provide an upward force that returns the inner portion to a position substantially level with the outer portion when the locking mechanism is released.

In some implementations, the platform may include a receptacle for receiving and holding a cosmetic applicator. The receptacle may be defined by a top surface of the inner portion and sidewalls extending upwardly from a perimeter of the inner portion. The cosmetic applicator may comprise a sponge, a brush, or a flocking.

Multiple and varied example implementations and embodiments are described below. However, these examples are merely illustrative and other implementations and embodiments of a loose powder compact with a compressible platform may be implemented without departing from the scope of the disclosure. For instance, the implementations, or portions thereof, may be rearranged, combined, used together, may omit one or more portions, and/or may be otherwise modified to arrive at variations on the disclosed implementations.

Illustrative Loose Powder Compact with Compressible Platform

The embodiments shown in the figures are presented by way of example. The components shown in the figures may be combined as desired to create a loose powder compact having various configurations. As noted above, components shown in the figures may be rearranged, combined, modified, duplicated, and/or omitted in some configurations.

Figure 2:
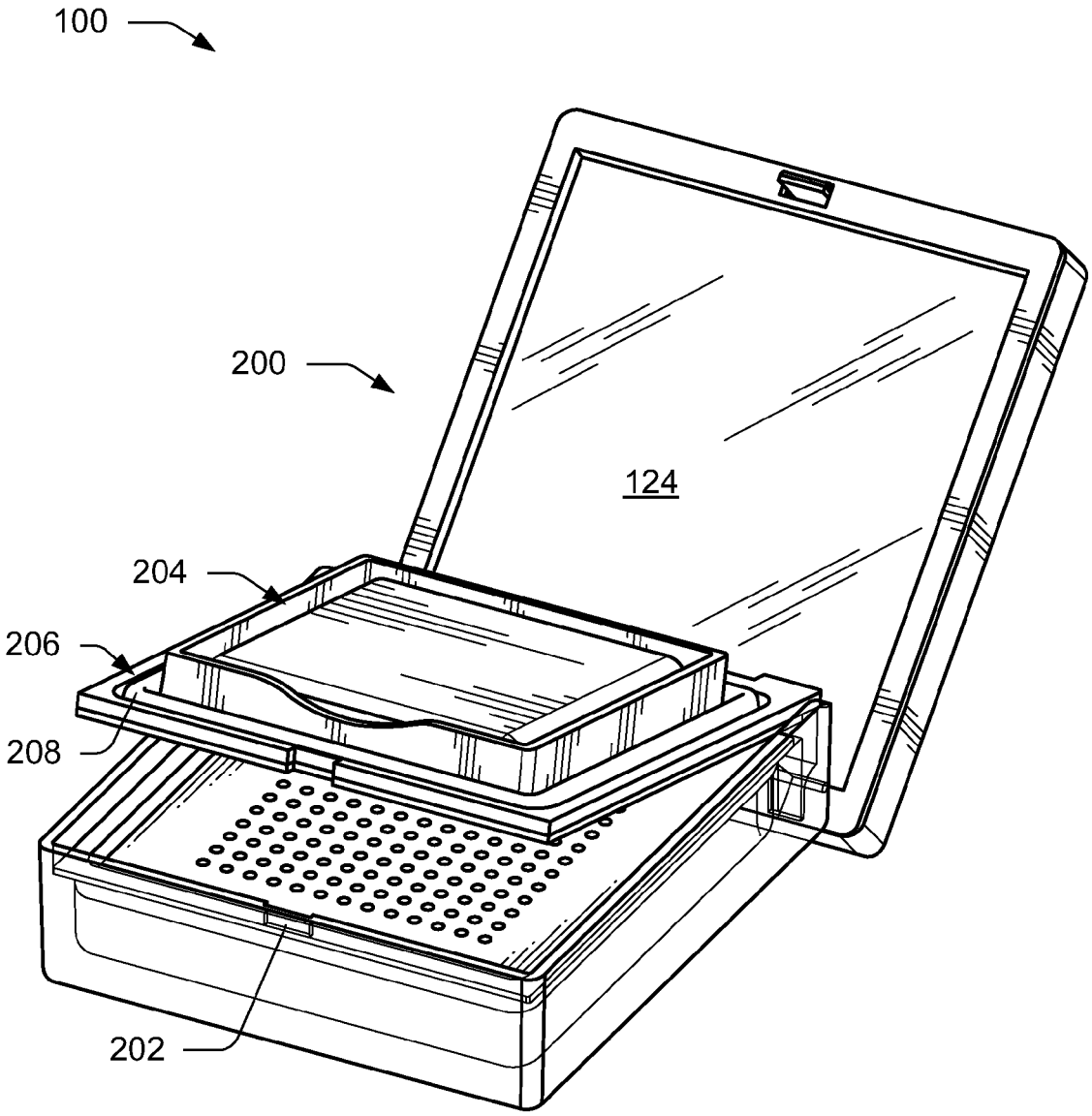
FIG. 2 is a perspective view of the compact of FIG. 1 in an open position with a platform rotated away from a sifter.

FIG. 1 illustrates a loose powder compact 100 in an exploded view. The loose powder compact 100 may include a base 102, a cover 104, and a platform 106. In some embodiments, the cover 104 may pivotably couple to the base 102 via a hinge arrangement 108 on a rear side of the compact 100. For instance, the hinge arrangement 108 may include a protrusion 110 that extends away from the cover 104 and fits into a gap 112 on the base 102. In some examples, the platform 106 may also be pivotably coupled to the base 102. The platform 106 may include a first protrusion 114 and a second protrusion 116 that mate with a first flange 118 and a second flange 120 on either side of the gap 112, respectively. The first and second protrusions 114 and 116 may be substantially narrow so that the gap 112 is maintained and the protrusion 110 of the cover 104 may fit in the gap 112, mating to the first and second protrusions 114 and 116. In some embodiments, hinge arrangement 108 may allow both the cover 104 and the platform 106 to be hingedly coupled to the base 102 simultaneously, as illustrated in FIG. 2. Vessels with this configuration may, in some instances, be referred to as a "wet/dry" construction.

In some embodiments, the cover 104 and/or platform 106 may be coupled to the base 102 using various other coupling arrangements. For instance, there may be a single hinge connected to both the cover 104 and the platform 106, or there may be multiple separate hinges. The coupling arrangement may include a spring-loaded hinge. The coupling arrangement may provide for the cover 104 and/or platform 106 to be removably coupled to the base 102, such as a snap-fit. The coupling arrangement may be positioned at the rear side of the compact 100, or on a left side, a right side, a front side, or a combination thereof. The coupling arrangement may have a single degree of freedom, such as the single axis of rotation illustrated above, or it may have multiple degrees of freedom, such as a lifting motion, twisting motion, compressing motion, sliding motion, rotating motion, or combinations thereof.

In some embodiments, the cover 104 and/or the platform 106 may be removably coupled to the base 102 in another manner. For instance, the loose powder compact 100 may have a substantially round form factor, providing a screw-type connection. The cover 104 and/or platform 106 may be coupled to the base 102 with a living hinge. Further, the platform 106 may lack any hinge feature and may couple to the base merely by resting in accordance with a downward gravitational force.

In some non-limiting embodiments, the base 102, cover 104, and/or platform 106 may be comprised of plastic, metal, ceramic, glass, carbon-fiber, stone, wood, composites thereof, combinations thereof, or any other type of material sturdy enough to maintain its shape and function during use. The base 102, cover 104, and/or platform 106 may be comprised of the same materials, different materials, or any combination thereof.

In some examples, the cover 102 may comprise a substantially rectangular form factor, with a planar top 120 and a plurality of planar sides 122 extending away from the planar top 120. A mirror 124 may be disposed on an underside of the planar top 120, the mirror being exposed when the cover 104 is in an open position 200, as shown in FIG. 2. Other features may be positioned on the underside of the planar top 120, such as an applicator (e.g. brush) or a cosmetic product (e.g. compact powder). The exterior of the base 102 and/or cover 104 may provide surfaces on which branding, advertisements, user directions, product information, or other text and/or images may be displayed.

The cover 104 may include a locking mechanism 126 disposed on one of the plurality of planar sides 122 for maintaining the cover 104 in a closed position 400 (shown in FIG. 4) and/or releasing the cover 104 into the open position 200. In some embodiments, the locking mechanism 126 may include a push-button tab configuration wherein depressing a push-button 128 moves a deflectable tab 130 allowing it to release from a cavity 202 (shown in FIG. 2). Various types of locking mechanisms may be used in other embodiments, such as hooks-and-loops, magnetic connectors, sliding locks, spring-loaded buttons, pull tabs, pins-and-hooks, or any other mechanism that maintains the cover 104 in the closed position 400 and can be actuated by a user to release the cover 104.

Figure 3:
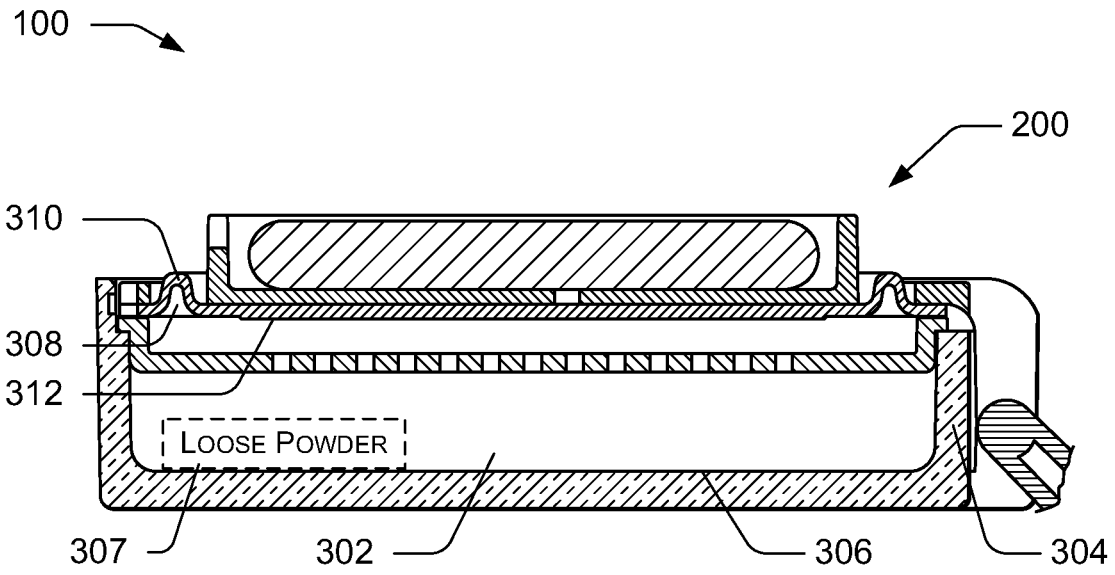
FIG. 3 is a cross-sectional side view of the compact of FIG. 1 in an open position with the cover omitted for clarity.
Figure 4:
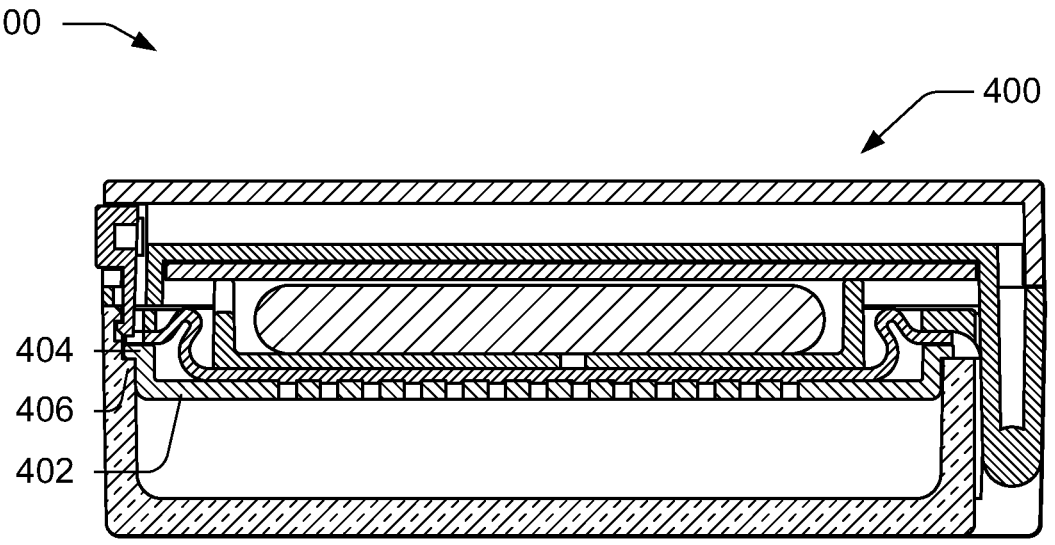
FIG. 4 is a cross-sectional side view of the compact of FIG. 1 in a closed position.

FIGS. 3 and 4 show the compact 100 in the open position 200 and the closed position 400, respectively. In some embodiments, outer edges of the cover 104 may align with outer edges of the base 102 when the compact 100 is in the closed position 400. The base 102 may comprise an inner cavity, or pot 302 defined by a plurality of walls 304 extending upward from a bottom surface 306 of the base 102. A cosmetic product, such as a loose powder 307 shown schematically), may be disposed within the pot 302. In some examples, the base 102 and/or the pot 302 may be comprised of a transparent or translucent material making the cosmetic product within externally viewable. For instance, the base 102 and/or the pot 302 may comprise clear polymer, ceramic, glass, crystal, or combinations thereof. In some embodiments, the base 102 may not be rectangular, but rather circular, oval, triangular, or any other shape, regular or irregular, configured to align with the cover 104. Likewise, the cover 104 may be any of the aforementioned shapes, a substantially similar shape as the base 102, or a substantially different shape than the base 102.

In some embodiments, a sifter 402 may be positioned above the pot 302. For example, the sifter 402 may extend to the plurality of walls 304, enclosing the cosmetic product in the pot 302. The sifter 402 may be substantially planar with a perimeter comprised of an elevated lip 404. The elevated lip 404 may rest on a ledge 406 disposed around an inner surface of the plurality of walls 304.

Figure 5:
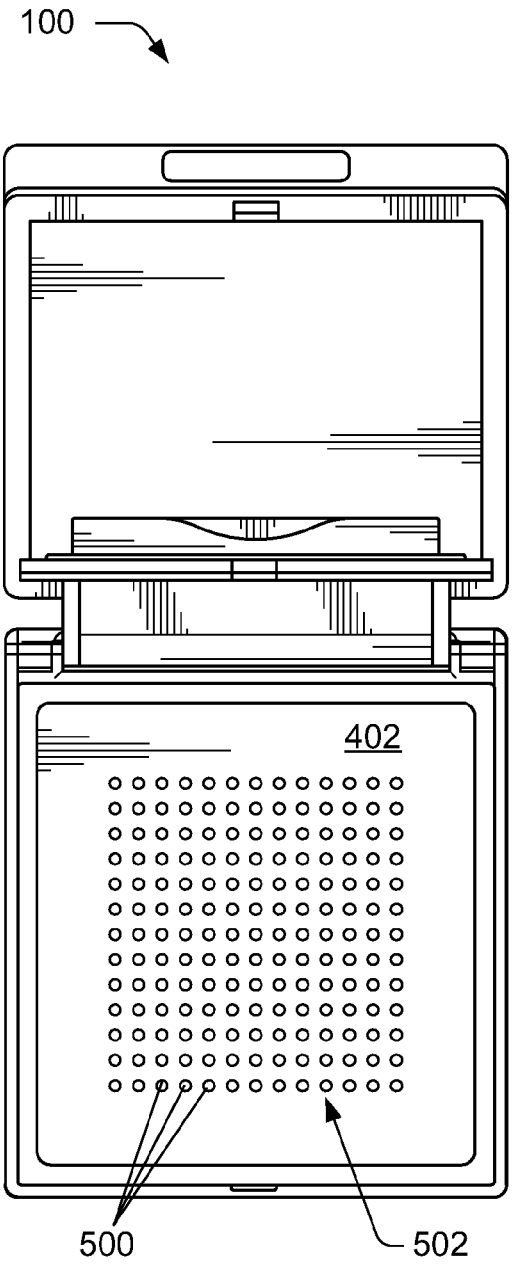
FIG. 5 is a top view of the compact of FIG. 1 in an open position with the platform in a raised, open position.

As illustrated in FIG. 5, the sifter 402 may include a plurality of perforations 500. In some examples, the plurality of perforations 500 may be arranged in an array 502. The plurality of perforations 500 may extend to the plurality of side walls 304, or they may span only a portion of the sifter 402. The sifter 402 may be permanently coupled to the base 102, in some embodiments, and removably coupled to the base 102 in others so the pot 302 may be refilled once the cosmetic product has been depleted. In other embodiments, the sifter 402 may be a wire mesh, rigid cloth, or any other construction that limits the dispensing rate of the cosmetic product. The sifter 402 may be comprised of plastic, metal, ceramic, glass, stone, wood, carbon-fiber, composites thereof, combinations thereof, or any other type of rigid material that may be perforated.

Some embodiments of compact 100 may include the platform 106 disposed between the sifter 402 and the cover 104. As disclosed above, the platform 106 may be coupled to the base 102 via hinge arrangement 108. Returning to FIG. 2, the platform 106 may comprise an inner portion 204 and an outer portion 206 disposed around the inner portion 204. The inner portion 204 may be flexibly coupled to the outer portion 206 with a gasket 208. In some embodiments, the gasket 208 may be a silicone sheet that couples to an underside of the outer portion 206, projects into a gap 308 (shown in FIG. 3) between the inner portion 204 and outer portion 206, and at least partially couples to an underside of the inner portion 204. A gasket bulge 310 may be formed by the projection into the gap 308 of the gasket 208.

In some examples, the inner portion 204 may be depressible relative to the outer portion 206. For instance, the cover 104 may come in contact with the inner portion 204 when the compact 100 is moved into the closed position 400, imparting a downward force on the inner portion 204. The gasket bulge 310 may deform so that the inner portion 204 moves downward relative to the outer portion 206 in a substantially linear path. In some examples, a bottom surface 312 of the inner portion 204 may come in contact with the sifter 402 when compressed by the cover 104. The gasket 208 may be disposed on and coupled to the bottom surface 312 of the inner portion 204 such that it abuts the sifter 402 and creates a seal against the plurality of perforations 500 of the sifter 402 when the inner portion 204 is depressed by the cover 104. Consequently, the cosmetic product disposed in the base 102 may be isolated when the compact 100 is in the closed position 400.

The cover 104 may be held in the closed position 400 by the locking mechanism 126, as described above. When the locking mechanism 126 is actuated, the cover 104 may be moved into the open position 200, removing the downward force the cover 104 may have imparted on the inner portion 204. In the absence of the downward force, the deformation of the gasket bulge 310 may provide an upward force, returning the inner portion 204 to a raised position and releasing the seal the inner portion 204 had formed against the sifter 402.

In some embodiments, the hinge arrangement 108, or the locking mechanism 126, or both may be spring-loaded. This stored potential energy, in the closed position 400, may be released upon actuation of the locking mechanism 126, causing the cover to spring or "pop" open.

In some examples, opening the compact 100 and separating the seal of the inner portion 204 against the sifter 402 with a single actuation of a single locking mechanism 126, with or without spring-loaded assistance, may make the compact 100 easier to use quickly and cleanly than previous designs.

In some embodiments, the gasket 208 may comprise a silicone sheet, as disclosed above. However, the gasket 208 may comprise any type of material with flexibility and compression such as thermoplastics, semi-solid gels, foams, and/or rubber. Alternatively, a living hinge (not shown) may be used to flexibly couple the inner portion 204 to the outer portion 206. In such examples, a liner (not shown) may be coupled to the bottom surface 312 of the inner portion 204 to compress against and seal the sifter 402 when the compact 100 is in the closed position 400. Although the gasket 208 is illustrated in FIG. 6 as coupling the entire perimeter of the inner portion 204 to the outer portion 206, the gasket 208 or living hinge may flexibly couple only a section of the inner portion 204 to the outer portion 206.

In some embodiments, the cover 104 may be movable in a direction substantially parallel to the base 102. For instance, the base 102 may have a sliding channel disposed on an outer surface configured to mate with a tab protruding from the cover 104 to guide a sliding motion. In this instance, the cover 104 may compress the inner portion 204 against the sifter 402 when in the closed position 400, and may be slid away from the base 102 to release the inner portion 204 from the sifter 402.

Figure 6:
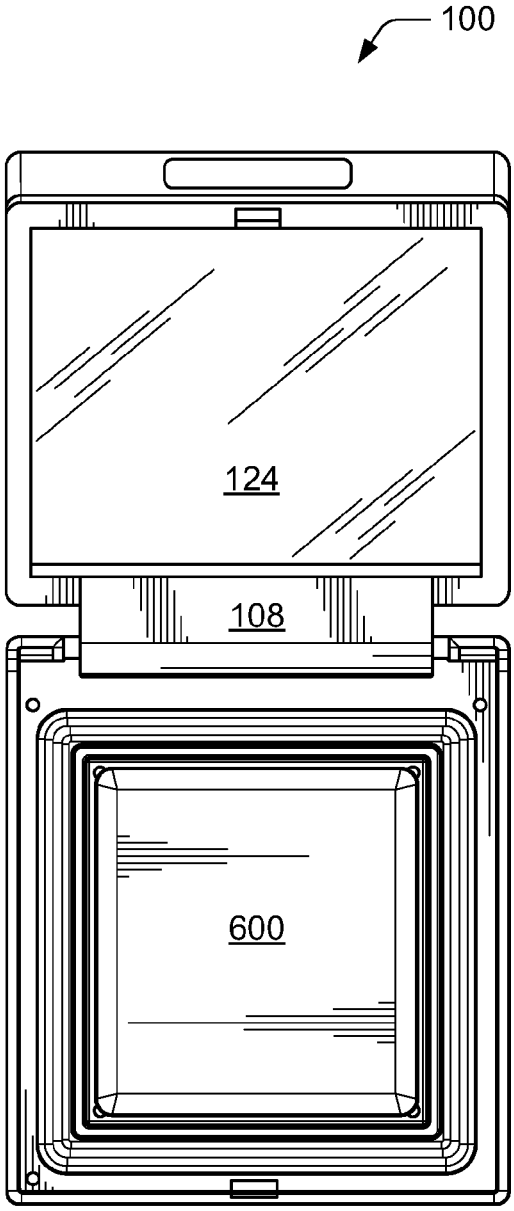
FIG. 6 is a top view of the compact of FIG. 1 in an open position with the platform in a lowered but unsealed position.
Figure 7:
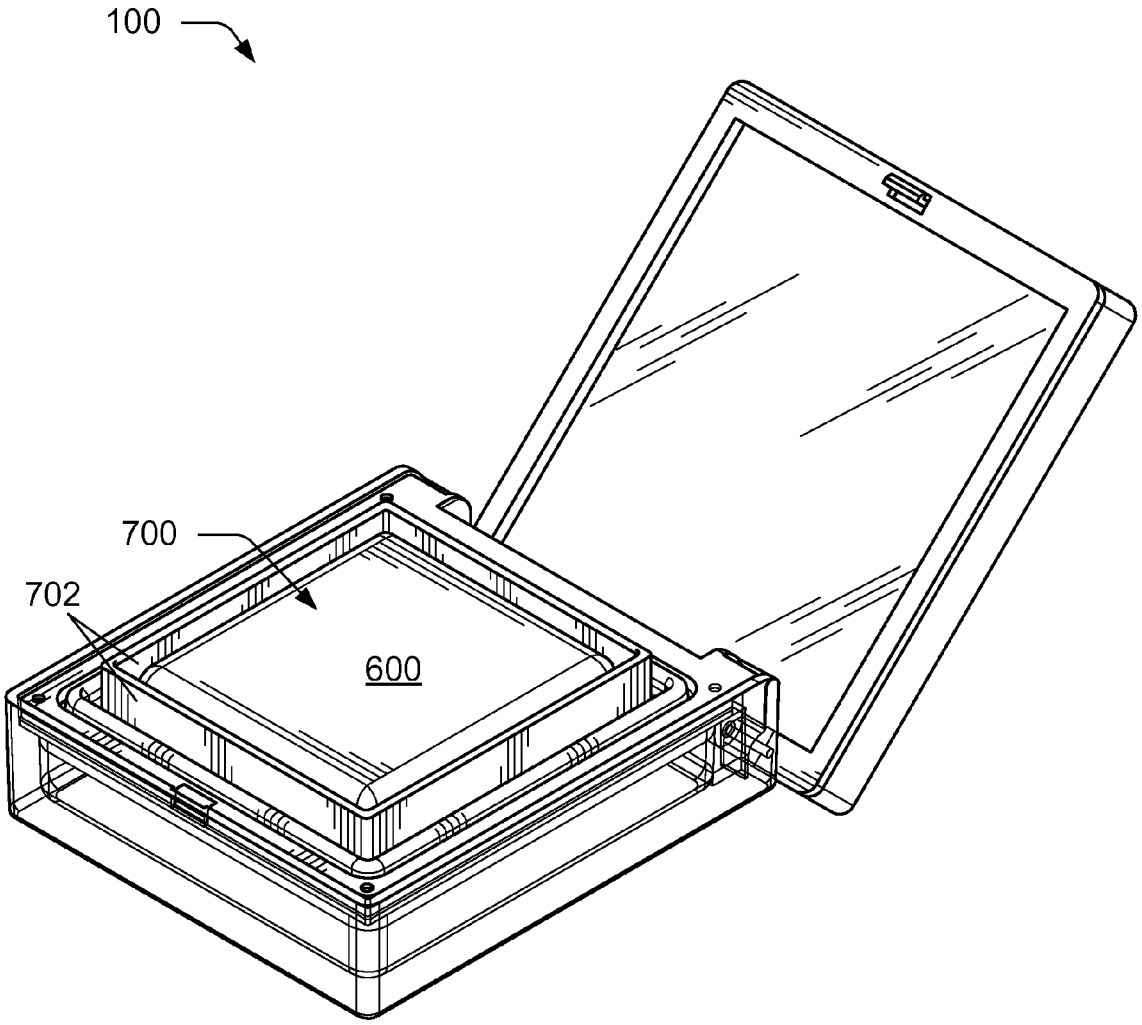
FIG. 7 is a perspective view of the compact of FIG. 1 with the cover in an open position and the platform in a lowered but unsealed position.

As illustrated in FIGS. 6 and 7, some embodiments of the platform 106 may include an applicator 600 received by a receptacle 700. The receptacle 700 may be a space defined on a top surface of the inner portion 204 by sidewalls 702 extending substantially upward from a perimeter of the inner portion 204. The applicator 600 may be a sponge, as illustrated in FIGS. 6 and 7, a brush, or a flocking (not shown). Additional features may be disposed in the receptacle 700 for holding the applicator 600 in place, such as a snap retention fitting (not shown).

In another embodiment, the receptacle 700 may be configured to receive a cosmetic product different from the cosmetic product contained in the base 102. For instance, the receptacle could receive a compact powder, cream, wax, liquid, and/or gel.

CONCLUSION

Although the loose powder compact has been described in language specific to structural features and/or methodological acts, it is to be understood that the disclosure is not necessarily limited to the specific features or acts described. Rather, the specific features and acts are disclosed as illustrative forms of implementing the loose powder compact.

What is claimed is:

1. A cosmetic compact comprising:
- a base;
- a cover pivotably coupled to the base;
- a sifter comprised of a rigid material disposed between the base and the cover; and
- a platform coupled to the base, the platform comprising a depressible portion that abuts the sifter in a closed position and is separate from the sifter in an open position, in the closed position the cover displaces the depressible portion to abut the sifter, and in the open position the cover releases the depressible portion to separate the depressible portion from the sifter.

2. The cosmetic compact of claim 1, wherein the depressible portion is flexibly coupled to an outer portion of the platform with an elastomeric gasket.

3. The cosmetic compact of claim 2, wherein the elastomeric gasket comprises a bottom surface of the depressible portion and compresses against the sifter to seal the sifter in the closed position.

4. The cosmetic compact of claim 1, wherein the depressible portion is flexibly coupled to an outer portion of the platform.

5. The cosmetic compact of claim 1, wherein the bottom surface of the depressible portion comprises a sealing gasket.

6. The cosmetic compact of claim 1, further comprising a pot disposed below the sifter for containing a cosmetic product.

7. The cosmetic compact of claim 6, wherein the base, the pot, or both are comprised of transparent material.

8. A cosmetic container comprising:
- a base;
- a cover coupled to the base and movable between an open position and a closed position;
- a perforated divider disposed in the base; and
- a platform positioned above the perforated divider, the platform being:
  - compressed against the perforated divider by the cover when the cover is in the closed position, and
  - separated from the perforated divider when the cover is in the open position; and
- the base comprises a material with a shape that is maintained during use.

9. The cosmetic container of claim 8, wherein the platform comprises an inner portion flexibly coupled to an outer portion such that the inner portion moves relative to the outer portion when the cover is moved between the open position and the closed position.

10. The cosmetic container of claim 9, further comprising a gasket disposed at least on a bottom surface of the inner portion of the platform and coupling the inner portion to the outer portion.

11. The cosmetic container of claim 10, wherein the gasket comprises a silicone based material.

12. The cosmetic container of claim 8, further comprising a cosmetic applicator positioned on a surface of the platform opposite the perforated divider.

13. The cosmetic container of claim 12, wherein the cosmetic applicator comprises a sponge.

14. The cosmetic container of claim 8, wherein the platform creates a seal when compressed against the perforated divider, enclosing a cosmetic product disposed in the base.

15. The cosmetic container of claim 8, wherein the platform is released from the perforated divider when the cover is in the open position.

16. A container comprising:

a base with a loose powder disposed in the base;

a cover coupled to the base;

a perforated divider at least partially enclosing the loose powder;

a platform hingedly coupled to the base; and a depressible portion of the platform flexibly coupled to an outer portion of the platform disposed around the depressible portion, the depressible portion is compressible against the perforated divider to create a seal by moving the cover into a closed position, displacing the depressible portion relative to the outer portion.

17. The container of claim 16, wherein the platform comprises a gasket that flexibly couples the depressible portion to the outer portion of the platform, the outer portion being coupled to the base.

18. The container of claim 17, wherein the gasket is at least partially disposed on a bottom surface of the depressible portion.

19. The container of claim 17, wherein the gasket is comprised of a thermoplastic.

20. The container of claim 17, wherein the gasket provides an upward force when the cover is moved from the closed position to an open position, releasing the depressible portion from the perforated divider.

21. The container of claim 17, wherein the cover applies a downward force on the depressible portion, moving it relative to the outer portion, when the cover is moved into the closed position.

22. The container of claim 16, wherein the loose powder is contained when the depressible portion is compressed by the cover and accessible when the depressible portion is released.

23. The container of claim 16, further comprising a release mechanism that moves the cover between the closed position and an open position when actuated.

* * * * *